US008488996B2

(12) United States Patent
Tomatsu

(10) Patent No.: US 8,488,996 B2
(45) Date of Patent: Jul. 16, 2013

(54) DRIVING FORCE TRANSMISSION MECHANISM AND IMAGE FORMING APPARATUS

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 344 days.

(21) Appl. No.: 13/013,453

(22) Filed: Jan. 25, 2011

(65) Prior Publication Data

US 2011/0182623 A1 Jul. 28, 2011

(30) Foreign Application Priority Data

Jan. 28, 2010 (JP) ..... 2010-017312

(51) Int. Cl.
*G03G 15/00* (2006.01)

(52) U.S. Cl.
USPC ..... 399/167

(58) Field of Classification Search
USPC ..... 399/116, 117, 159, 167; 74/411; 464/37, 464/158
See application file for complete search history.

(56) References Cited

U.S. PATENT DOCUMENTS

| | | | | |
|---|---|---|---|---|
| 5,128,715 | A | 7/1992 | Furuyama et al. | |
| 6,574,446 | B2 | 6/2003 | Kitayama | |
| 7,941,076 | B2 * | 5/2011 | Oohara et al. | 399/167 |
| 2002/0025191 | A1 | 2/2002 | Kitayama | |
| 2005/0111882 | A1 | 5/2005 | Sudo et al. | |
| 2007/0189805 | A1 | 8/2007 | Takigawa | |
| 2008/0152388 | A1 | 6/2008 | Ueno et al. | |
| 2009/0169253 | A1 | 7/2009 | Kamimura et al. | |
| 2009/0304412 | A1 | 12/2009 | Hattori et al. | |
| 2009/0317132 | A1 | 12/2009 | Asanuma et al. | |

FOREIGN PATENT DOCUMENTS

| | | | |
|---|---|---|---|
| JP | 01-164818 | A | 6/1989 |
| JP | 4218067 | A | 8/1992 |
| JP | 4278961 | A | 10/1992 |
| JP | 2002031153 | A | 1/2002 |
| JP | 2002048148 | A | 2/2002 |
| JP | 2004045603 | A | 2/2004 |
| JP | 2007240007 | | 9/2007 |
| JP | 2009162904 | | 7/2009 |
| JP | 2009162913 | | 7/2009 |
| JP | 2010002689 | A | 1/2010 |

OTHER PUBLICATIONS

Extended European Search Report issued in the corresponding European patent application 10016147.0 on Oct. 5, 2012.
Notification of Reason for Refusal for Japanese patent application No. 2010-017312 mailed Dec. 20, 2011.

* cited by examiner

*Primary Examiner* — Hoan Tran
(74) *Attorney, Agent, or Firm* — Banner & Witcoff, Ltd.

(57) ABSTRACT

A driving force transmission mechanism is provided. The driving force transmission mechanism includes an input member including a concave shape portion; a rotation driving shaft; and a driving force transmission member that is configured to rotate in a rotation direction of the rotation driving shaft together with the rotation driving shaft. A protrusion is formed on a surface of a tip end portion of the driving force transmission member, the surface is opposed to the concave shape portion, the protrusion is configured to be engaged, from an inner side, with an edge of the concave shape portion when the tip end portion is in a contact with the edge of the concave shape portion and is tilted.

8 Claims, 11 Drawing Sheets

DRIVING FORCE TRANSMISSION MECHANISM AND IMAGE FORMING APPARATUS

CROSS REFERENCE TO RELATED APPLICATION

The present application claims priority from Japanese Patent Application No. 2010-017312, which was filed on Jan. 28, 2010, the disclosure of which is herein incorporated by reference in its entirety.

TECHNICAL FIELD

The apparatuses and devices consistent with the invention relate to a driving force transmission mechanism transmitting driving force from a driving force supplying member having a driving source to a driving force receiving member attachable/detachable to/from the driving force supplying member; and an image forming apparatus having the driving force transmission mechanism.

BACKGROUND

There is a related art image forming apparatus which includes a process cartridge having a photosensitive drum rotating with holding a developer image thereon; an apparatus main body to or from which the process cartridge is attachable or detachable; and a driving force transmission mechanism transmitting a driving force from a driving source provided in the apparatus main body to the process cartridge. Specifically, the driving force transmission mechanism in the related art includes an input member rotatably attached in the process cartridge; a rotation driving shaft rotatably attached in the apparatus main body; and a driving force transmission member rotating together with the rotation driving shaft and being able to move forward/backward relative to the process cartridge in a parallel direction with a rotation axis of the rotation driving shaft.

Moreover, in the related art, a diameter of a tip end of the rotation driving shaft becomes smaller than that of a rear end of the rotation driving shaft. In this way, when the driving force transmission member moves forward, there occurs a gap between the driving force transmission member and the tip end of the rotation driving shaft. Accordingly, the driving force transmission member may swing with respect to the rear end thereof. Therefore, even when a central axis of the rotation driving shaft and a central axis of the input member become more or less deviated from each other, the rotation driving shaft and the input member are reliably engaged with each other, so that the driving force is transmitted to the process cartridge.

SUMMARY

In the approach of the related art, however, in case the central axis of the rotation driving shaft and the central axis of the input member, when mounting the process cartridge, become deviated beyond an allowable range from each other due to manufacturing error, the rotational central point of the tip end of the driving force transmission member moving forward gets in a contact with an edge of the concave shape portion of the input member and thus there may occur the problem that the driving force transmission member is kept in an oblique state while a portion thereof enters into the concave shape portion. Otherwise, the driving force transmission member may swing when moving forward and thus the rotational central point of the tip end thereof gets in a contact with the edge of the concave shape portion of the input member and thus there may occur the problem that the driving force transmission member is kept in an oblique state while a portion thereof enters into the concave shape portion.

When the driving force transmission member is kept in an oblique state, the driving force may not be transmitted to the process cartridge. It is because that though the driving force may be transmitted to the driving force transmission member, the driving force transmission member will keep on rotating with respect to a rotational center of the tip end thereof which is in a contact with the edge of the concave shape portion, and a whole portion of the tip end does not enter into the concave shape portion.

Therefore, according to the related art, positioning portions of the process cartridge and the apparatus main body must be fabricated with high precision; or high position precision is required in fabricating the input member of the process cartridge, the rotation driving shaft and the driving force transmission member.

Accordingly, an object of the invention is to provide a driving force transmission mechanism for broadening the allowable range of the deviation between the central axis of the rotation driving shaft and the central axis of the input member; and an image forming apparatus including the driving force transmission mechanism.

According to an illustrative aspect of the present invention, there is provided A driving force transmission mechanism that is provided between a driving force supplying member having a driving source and a driving force receiving member configured to be detachably provided in the driving force supplying member, the driving force transmission mechanism configured to transmit driving force from the driving force supplying member to the driving force receiving member, the driving force transmission mechanism comprising: an input member that is rotatably provided in the driving force receiving member, the input member including a concave shape portion that receives the driving force from the driving force supplying member; a rotation driving shaft that is rotatably provided in the driving force supplying member; and a driving force transmission member that is configured to rotate in a rotation direction of the rotation driving shaft together with the rotation driving shaft, the driving force transmission member configured to be movable forward and backward relative to the driving force receiving member in a parallel direction with a rotation axis line of the rotation driving shaft, the driving force transmission member being supported by the rotation driving shaft so that a tip end portion of the driving force transmission member, which is close to the driving force receiving member, swings in a direction perpendicular to the rotation axis line of the rotation driving shaft, the driving force transmission member configured to rotate together with the input member when the tip end portion enters into and is engaged with the concave shape portion, wherein when the driving force receiving member is mounted in the driving force supplying member, the input member has a substantially parallel rotation axis line with the rotation axis line of the rotation driving shaft; wherein when the tip end portion does not enter into the concave shape portion, the concave shape portion has at least a portion that is overlapped with the tip end portion when viewed in the direction of the rotation axis line of the driving shaft; and wherein a protrusion is formed on a portion of a surface of the tip end portion, the surface being opposed to the concave shape portion, the protrusion is configured to be engaged, from an inner side, with an edge of the concave shape portion when the tip end portion is in a contact with the edge of the concave shape portion and is tilted, the protrusion is formed on the portion that is deviated from the rotation axis line of the rotation driving shaft in a diameter direction with the rotation axis line of the input member.

According to another illustrative aspect of the present invention, there is provided an image forming apparatus, comprising: the driving force transmission mechanism according to the above illustrative aspect, wherein the driving force supplying member is an apparatus main body, and the driving force receiving member is a cartridge configured detachably provided in the apparatus main body.

In accordance with the invention, in case the surface of the tip end portion of the driving force transmission member gets in a contact with the edge of the concave shape portion of the input member and thus the driving force transmission member is kept in the oblique state, the protrusion on the surface comes into being engaged from the inner side with the edge of the concave shape portion by the rotation of the driving force transmission member around the rotational axis line. In this engagement state, the driving force transmission member further rotates around the engagement point, and, hence, the portion of the driving force transmission member positioned out of the concave shape portion rotates toward the inner side of the concave shape portion. Accordingly, the tip end portion of the driving force transmission member securely enters into the concave shape portion of the input member.

In accordance with the invention, even in case the surface of the tip end portion of the driving force transmission member gets in a contact with the edge of the concave shape portion of the input member, the tip end portion of the driving force transmission member may securely enter into the concave shape portion of the input member. Accordingly, the invention can broaden the allowable range of the deviation between the central axis of the rotation driving shaft and the central axis of the input member.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

One exemplary embodiment of the invention will be described in details with reference to the drawings. In following descriptions, an entire configuration of a color laser printer as one example of an image forming apparatus will be first described briefly with reference to FIG. 1 and then features of the invention will be describe in details.

<Entire Configuration of a Color Laser Printer>

Figure 1:
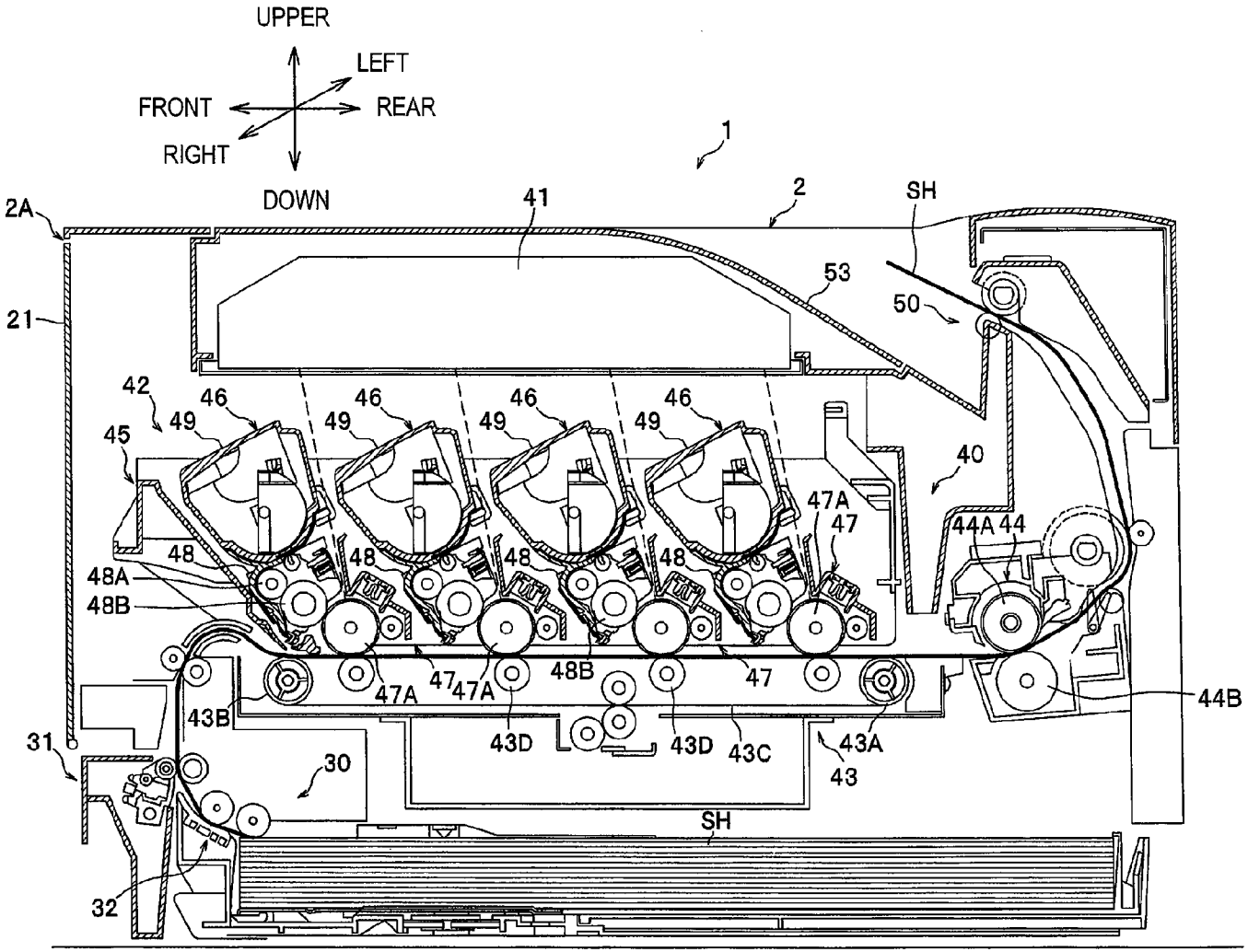
FIG. 1 is a cross-sectional view of a color laser printer according to one embodiment of the invention.
Figure 2:
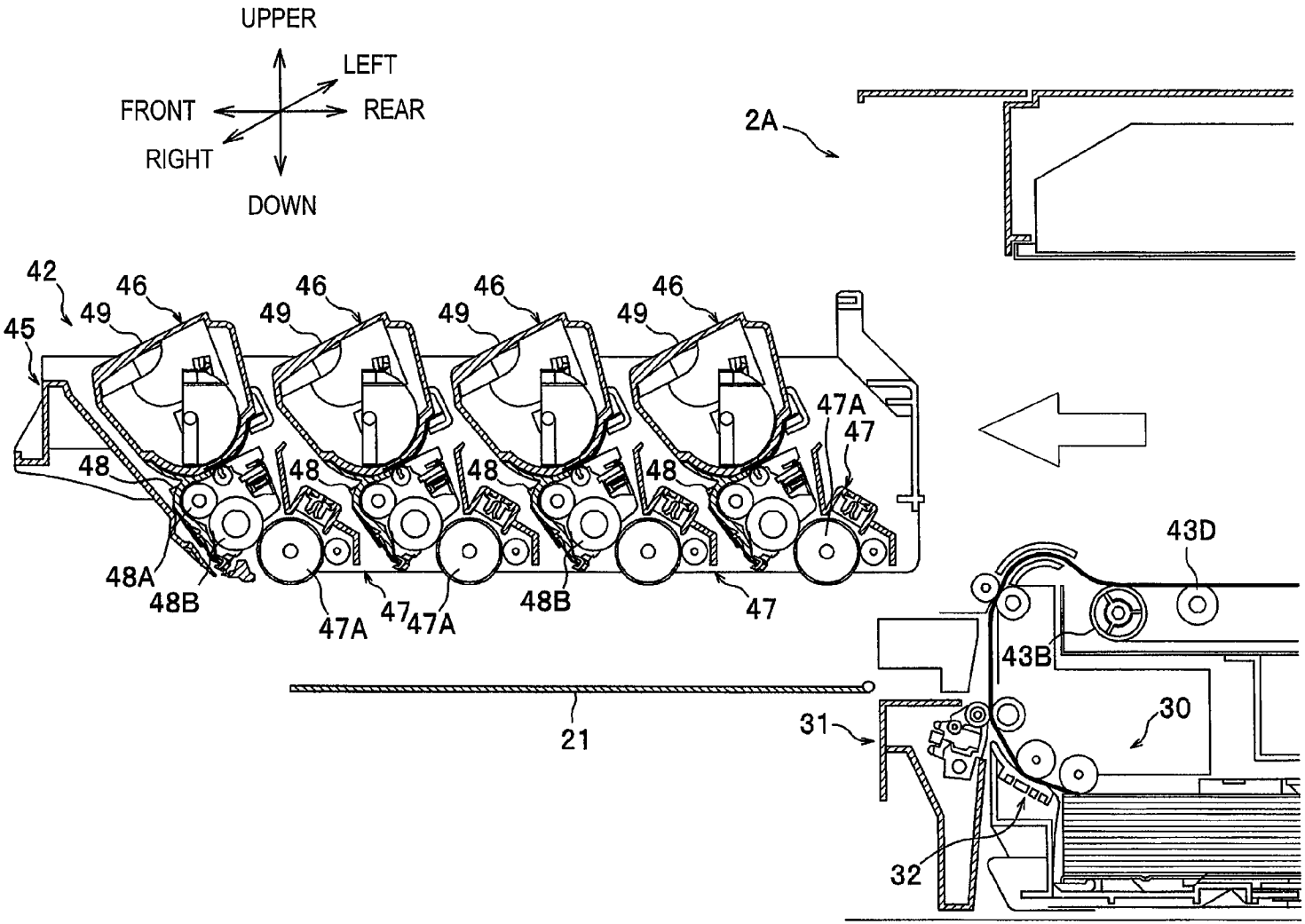
FIG. 2 is a cross-sectional view of the color laser printer when a drawer is pulled away from an apparatus main body.

As shown in FIG. 1, the color laser printer 1 includes a feeder unit 30 feeding a recording sheet SH into an apparatus main body 2 as one example of a driving force supplying member; an image forming unit 40 forming an image on the recording sheet SH fed from the feeder unit 30; and a sheet discharge unit 50 discharging from the main body 2 the recording sheet SH on which the image is formed by the image forming unit 40.

Meanwhile, upper, lower, right, left, front and rear directions as indicated in arrows in FIG. 1 are directions as viewed by a user standing in a front side of the color laser printer 1. In the following descriptions, upper, lower, right, left, front and rear directions, unless specified otherwise, complies with the directions as indicated in the arrows of FIG. 1.

An opening 2A is formed in a front side wall of the main body 2 so that a drawer 45 described later is detached through the opening 2A. A front cover 21 for opening and closing the openings 2A is provided so as to swing with respect to the shaft provided at a lower end thereof.

The feeder unit 30 includes a sheet feeding tray 31 attachable/detachable to/from the main body 2; and a sheet feeding mechanism 32 conveying the recording sheet SH from the sheet feeding tray 31 to the image forming unit 40.

The image forming unit 40 includes a scanning unit 41, a processing unit 42, a transferring unit 43 and a fixing unit 44.

The scanning unit 41 includes a laser emitting unit (not shown), a polygon mirror (not shown), a plurality of lenses (not shown), and a reflector (not shown). The scanning unit 41 emits laser lights corresponding to cyan, magenta, yellow and black onto each of photosensitive sensors 47A of a processing unit 42.

The processing unit 42 is disposed between the scanning unit and the transferring unit 43 and has the drawing 45 mounted in an attachable/detachable manner to/from the main body 2. The drawer 45, when the front cover 21 gets open, is movable horizontally from/to an accommodated position (a position in FIG. 1) in the main body 2 to/from a detached position (a position in FIG. 1) out of the main body 2. Within the drawer 45, a number (=4 in FIG. 1) of process cartridges 46 as one example of a driving force receiving member are arranged along the conveying direction of the recording sheet SH. Meanwhile, each of the process cartridges 46 may be mounted in an attachable/detachable way to/from the drawer 45 or may be mounted as one body with the drawer 45.

Each of the process cartridges 46 includes a drum unit 47 disposed at a lower section thereof, a developing unit 48 coupled in an attachable/detachable way to/from the drum unit 47, and a developer cartridge 49 coupled in an attachable/detachable way to/from the developing unit 48.

The drum unit 47 includes a photosensitive drum 47A and a charging device (not labeled with a reference numeral). The photosensitive drum 47A is rotatably supported with the drum unit 47.

The developing unit 48 includes a developing roller 48B and a supply roller 48A. Within the developer cartridge 49, developers made of single composition non-magnetic material corresponding to the cyan, magenta, yellow and black respectively are accommodated.

In the processing unit 42 configured in such a way, the surface of the photosensitive drum 47A charged by the charging device is exposed to the laser light emitted from the scanning unit 41 and then electrical potential at the exposed area becomes lower so that an electrostatic latent image is formed, based on an image data, on the photosensitive drum 47A. Further, the developer is supplied via the developing roller 48B being in a contact with the photosensitive drum 47A to the electrostatic latent image on the photosensitive drum 47A and in turn the developer image is held onto the photosensitive drum 47A.

The transferring unit 43 includes a driving roller 43A, a driven roller 43B, a conveying belt 43C and a transferring roller 43D.

The conveying belt 43C is disposed so as to face to the plurality of the photosensitive drums 47A. The conveying belt 43C rotates together with the rotation of the driven roller 43B when the driving roller 43A rotates. In the inner side of the conveying belt 43C, the transferring roller 43D is disposed so that the conveying belt 43C is sandwiched between the transferring roller 43D and each of the photosensitive drums 47A. A transfer bias from a high pressure substrate (not shown) is applied to the transferring roller 43D.

When the recording sheet SH conveyed with the conveying belt 43C is fed between the photosensitive drum 47A and the transferring roller 43D, the developer image on the photosensitive drum 47A is transferred to the recording sheet SH.

The fixing unit 44 includes a pressing roller 44B and a heating roller 44A. The fixing unit 44 thermally fixes the developer image onto the recording sheet SH by sending the recording sheet SH while kept between the pressing roller 44B and the heating roller 44A.

The sheet discharge unit 50 includes a plurality of conveying rollers (not labeled with a reference numeral) and conveys the recording sheet SH discharged from the fixing unit 44 toward a sheet discharging tray 53 above the fixing unit 44.

<Driving Force Transmission Mechanism>

A driving force transmission mechanism 60 provided between the main body 2 and the process cartridge 46 and transmitting a driving force from the main body 2 to the process cartridge 46 will be described in details with reference to FIG. 3.

Figure 3:
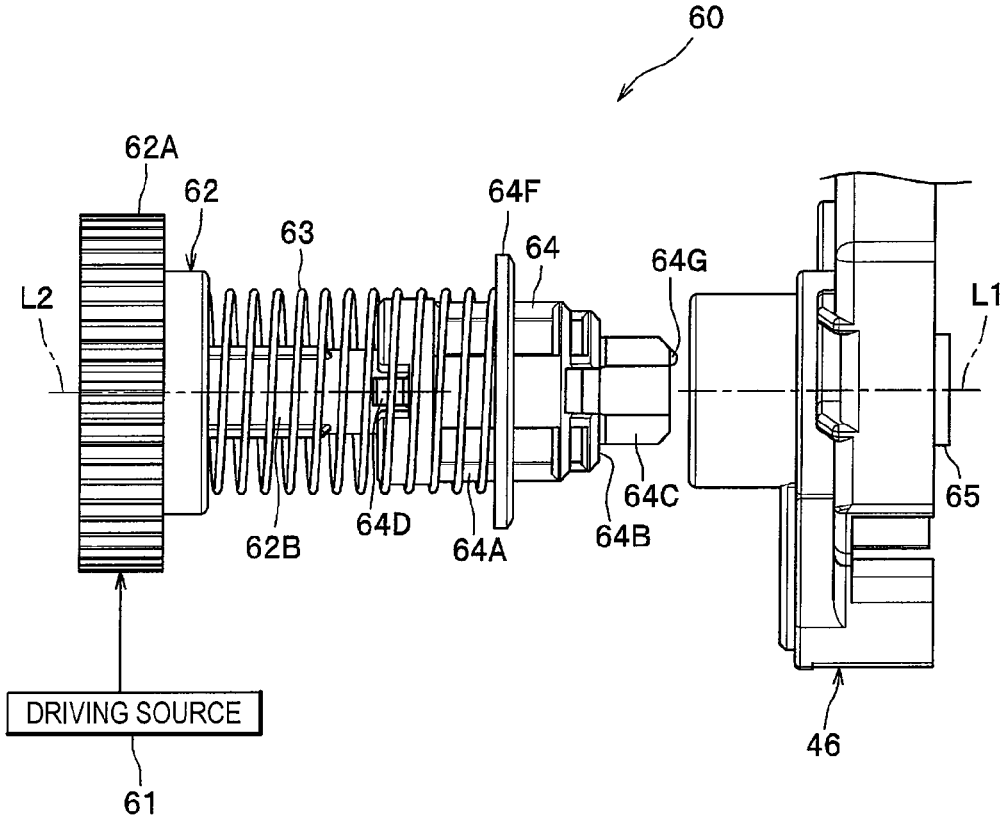
FIG. 3 is a plan view of a driving force transmission mechanism.

As shown in FIG. 3, the driving force transmission mechanism 60 includes a driving source 61 such as a motor provided in the main body 2, a rotation driving member 62 provided in the apparatus main body 2, a coil spring 63 as one example of spring means, a driving force transmission member 64 rotating together with the rotation of the rotation driving member 62, and an input member 65 rotatably provided in the process cartridge 46.

The driving source 61 is provided in the apparatus main body 2 and transmits the driving force to the rotation driving member 62 in a direct way or in a indirect way via a given number of gears.

The rotation driving member 62 is rotatably provided in the main body 2 and includes a gear portion 62A to which the driving force from the driving source 61 is mainly transmitted, and a cylindrical rotation driving shaft 62B protruding from a central region of the gear portion 62A toward the driving force transmission member 64. Meanwhile, the rotation driving shaft 62B is disposed so as to have a rotation axis line L2 substantially parallel with a rotation axis line L1 of the input member 65 in a state in which the process cartridge 46 is mounted onto the main body 2. At this state, before the tip end 64C of the driving force transmission member 64 enters into a concave shape portion 65A described later of the input member 65, the tip end 64C of the driving force transmission 64, when viewed in the rotation axis line L2 direction, has at least partial superposition with the concave shape portion 65A. Moreover, "the state in which the process cartridge 46 is mounted onto the main body 2" refers to a state in which in the embodiment, the drawer 45 on which the process cartridge 46 is mounted is mounted onto a given position in the apparatus main body 2.

The coil spring 63 is provided between the rotation driving member 62 and the driving force transmission member 64 so as to press the driving force transmission member 64 toward the input member 65.

The driving force transmission member 64 is configured to rotate together with the rotation of the rotation driving member 62 in the same rotation direction as the member 62 and to move forward and backward relative to the input member 65 in an axial direction (parallel with the rotation axis line L2) of the rotation driving shaft 62B. Specifically, the driving force transmission member 64 includes a cylindrical portion 64A into which the rotation driving shaft 62B enter, a wall 64B configured to close so as to close an input member side end face of the cylindrical portion 64A, the wall 64B facing to the input member 65, and a tip end 64C protruding from the wall 64B toward the input member 65.

Figure 4:
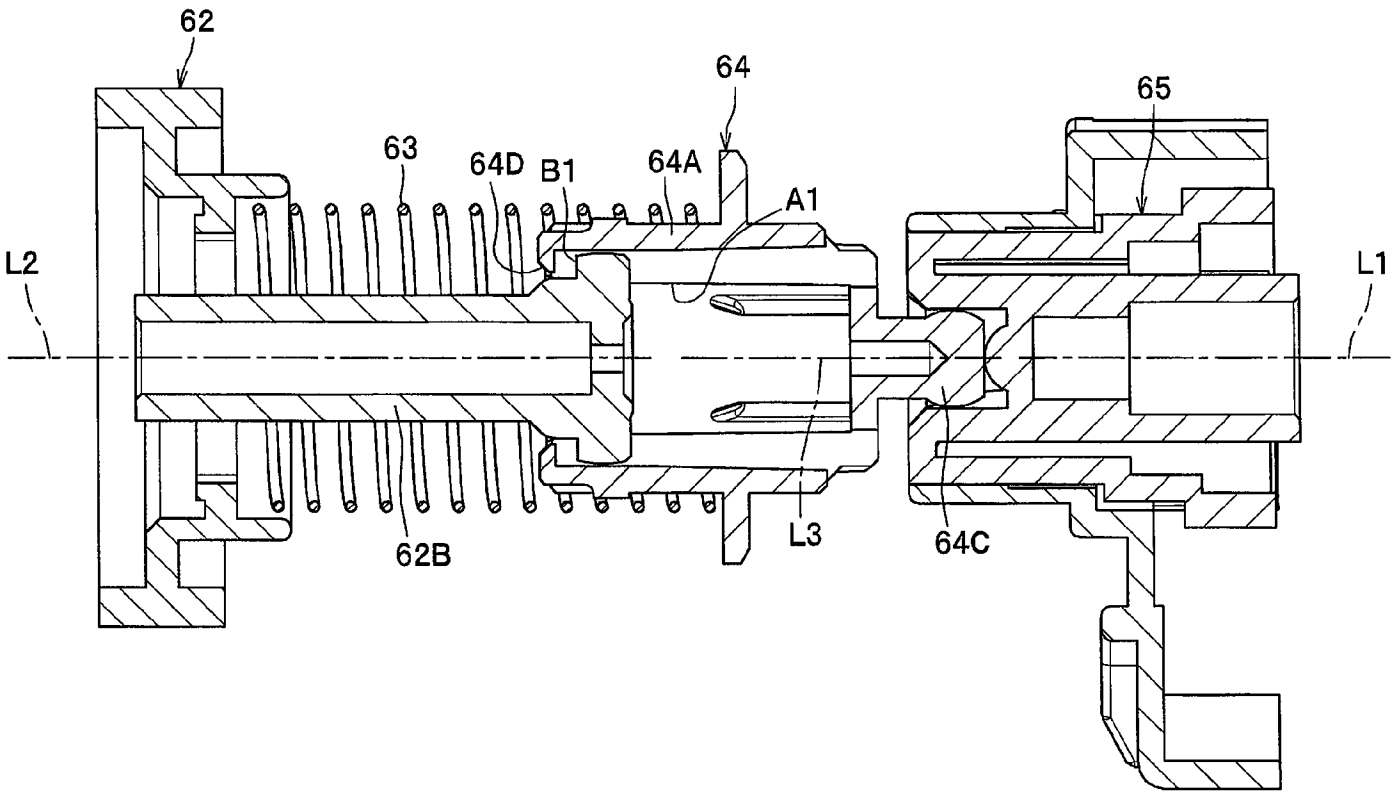
FIG. 4 is a cross-sectional view of the driving force transmission mechanism cut at a cross-section including an engagement protrusion.

An engagement protrusion 64D protruding toward an inner side of a diameter of the cylindrical portion 64A is formed at a rear end (a rotation driving shaft side) of the cylindrical portion 64A. The engagement protrusion 64D, as shown in FIG. 4, includes two engagement protrusions which face away each other. The two engagement protrusions 64D are engaged respectively with an engagement wall B1 formed at the tip end of the rotation driving shaft 62B so as to protrude toward an outer side of the diameter of the cylindrical portion 64A, so that the rotation driving shaft 62B is prevented from being detached or removed from the driving force transmission member 64.

On and along an inner periphery of the cylindrical portion 64A of the driving force transmission member 64, a rib A1 is formed, in a region at which the two engagement protrusions 64D are not formed, so as to protrude toward an inner side of the diameter of the cylindrical portion 64A. An end face of the rib A1 in a parallel direction with the rotation axis line L2 is engaged with the engagement wall B1 of the rotation driving shaft 62B in a rotation direction, so that the driving force transmission member 64 rotates, in the rotation direction, together with the rotation of the rotation driving shaft 62B.

Figure 5A:
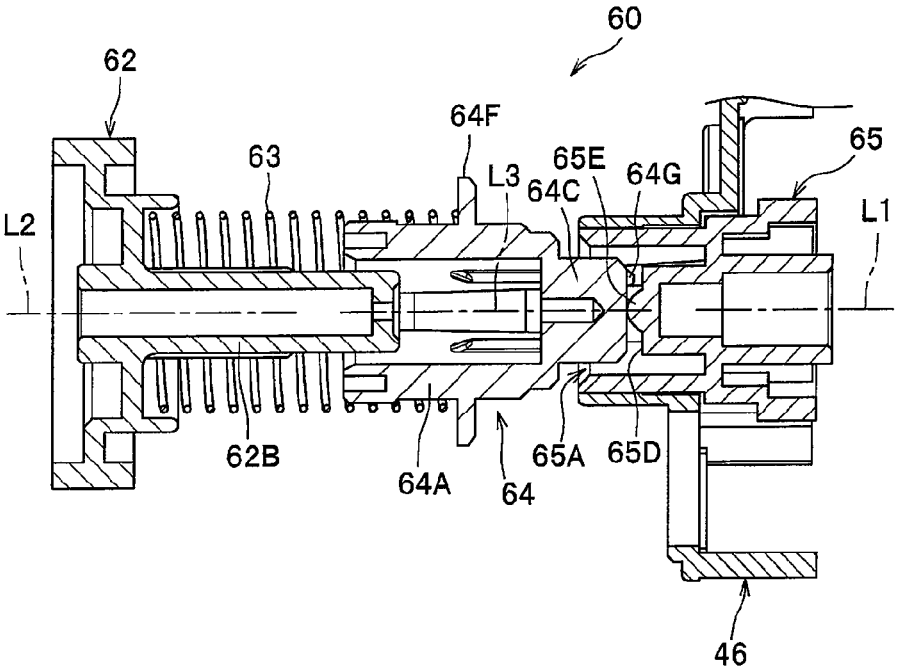
FIG. 5A is a cross-sectional view of the driving force transmission mechanism cut at a cross-section including a protrusion.

As shown in FIG. 5A, there is a gap between the cylindrical portion 64A and the rotation driving shaft 62B. In this way, the driving force transmission member 64 is supported with the rotation driving shaft 62B so that the tip end 64C thereof may swing in a direction perpendicular to the rotation axis line L2 of the rotation driving shaft 62B.

An annular flange 64F extending toward an outer side of the diameter of the cylindrical portion 64A is formed on an outer periphery of the cylindrical portion 64A. This annular flange 64F is pressed toward the input member 65 with the coil spring 63. Meanwhile, the annular flange 64F is pushed toward the rotation driving member 62 and against the pressing force of the coil spring 63 by a well-known cam member (not shown) moving forward in accordance with the opening of the front cover 21. In this way, when opening the front cover 21, the driving force transmission member 64 is withdrawn and separated from the input member 65. To the contrary, when closing the front cover 21, the cam member is withdrawn and separated from the annular flange 64F, so that the driving force transmission member 64 moves forward using the pressing force of the coil spring 63 and then is engaged with the input member 65. Meanwhile, the cam member is operated not only with the opening/closing of the front cover 21 but also by a motor, a solenoid or other driving sources.

Figure 5B:
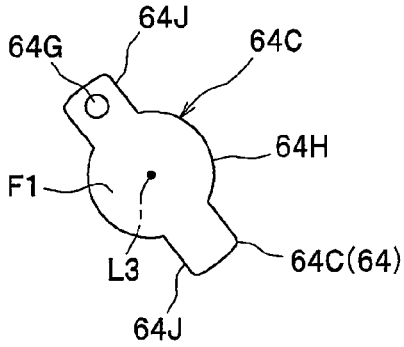
FIG. 5B shows a tip end of the driving force transmission member when viewed from a tip end thereof.
Figure 5C:
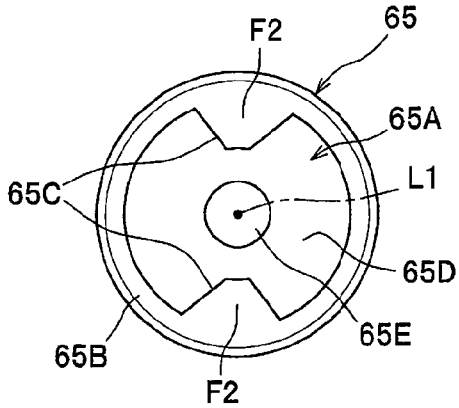
FIG. 5C shows a concave shape portion when viewed from an opening thereof.

As shown in FIG. 5B and FIG. 5C, the tip end 64C of the driving force transmission member 64 is shaped in such a way to enter into the concave shape portion 65A formed on the end face of the input member 65 and then be engaged with the concave shape portion 65A in a rotation direction. Accordingly, when the tip end 64C of the driving force transmission member 64 is engaged with the concave shape portion 65A, the input member rotates together with the rotation of the driving force transmission member 64. Moreover, on a tip end face F1 of the tip end 64C, a protrusion 64G being able to be engaged, from its inner side, with the edge of the concave shape portion 65A is formed so as to be positioned to be deviated, in a diameter direction, from a rotation axis line L3 of the driving force transmission member 64.

To be specific, the tip end 64C includes a central portion 64H formed in a circle circumference shape around the rotation axis line L3 of the driving force transmission member 64; and a pair of transmission side engagement portions 64J formed so as to sandwich the central portion 64H (the rotation axis line L3) therebetween and extend from the central portion 64H in an outer side direction of the diameter and in an opposite direction from each other. Each of the pair of transmission side engagement portions 64J is engaged respectively, in the rotation direction, with each of a pair of input side engagement portions 65C (described later) of the input member 65. The above-mentioned protrusion 64G is formed on the end face of one of the pair of transmission side engagement portions 64J. The above-mentioned protrusion 64G has a substantially semi-sphere shape tapering down.

As shown in FIG. 5B and FIG. 5C, the input member 65 is, in a rotatable manner, provided in the process cartridge 46, and has the concave shape portion 65A receiving the driving force from the apparatus main body 2. The concave shape portion 65A has a cylindrical shape with a closed bottom and primary includes an outer wall portion 65B of the cylindrical shape and the pair of the input side engagement portions 65C protruding from the outer wall portion 65B toward the inner side thereof.

Although not described in details, a gear teeth portion is included in the input member 65. The gear teeth portion is directly or indirectly engaged with driving gears of the above-described photosensitive drum 47A and the developing roller 48B so as to transmit the driving force thereto.

Each of the pair of the input side engagement portions 65C is formed so as to sandwich the rotation axis line L1 of the input member 65 therebetween and face away each other, and is engaged respectively with each of the pair of the transmission side engagement portions 64J of the tip end 64C of the driving force transmission member 64. Speaking specifically, tip edges of the input side engagement portions 65C extending toward the rotation axis line L1 are, in the rotation direction, respectively in a contact with and engaged with the end faces of the transmission side engagement portions 64J extending toward the central portion 64H. Meanwhile, a non-circular shape around the rotation axis line L3 may be employed in the tip end 64C, and, accordingly, the concave shape portion 65A may have a shape being able to be engaged in the rotation direction with the non-circular shape.

In a rotational center of the bottom 65D of the concave shape portion 65A, a semi-spherical convex portion 65E (see FIG. 5A) is formed to be in a contact with the tip end face F1 of the driving force transmission member 64 when the driving force transmission member 64 and the input member 65 are engaged with each other. Meanwhile, in this embodiment, on the central portion of the bottom 65D of the concave shape portion 65A, there is formed a protrusion toward the driving force transmission member 64, the protrusion being the semi-spherical convex portion 65E. In this way, when the rotation axis line L2 of the rotation driving shaft 62B and the rotation axis line L1 of the input member 65 are deviated from each other and thus the driving force transmission member 64 is tilted between the rotation driving shaft 62B and the input member 65 (i.e., in the concave shape portion 65A), the tip end face F1 of the driving force transmission member 64 may transmit the driving force of the rotation driving shaft 62B to the input member 65 without interfering with the bottom 65D since the tip end face F1 of the driving force transmission member 64 is in a contact with the convex portion 65E.

The protrusion 64G of the driving force transmission member 64 is formed to have a height so that the protrusion 64G does not interfere, when the tip end face F1 entered into the concave shape portion 65A has swung to a maximum degree with respect to the contact point of the convex portion 65E, with the convex portion 65E and the bottom 65D of the input member 65. In this way, when the driving force transmission member 64 and the input member 65 are engaged with each other so that the driving force is transmitted between them, the protrusion 64G is prevented from interfering with the rotation of the driving force transmission member 64.

Figure 6A:
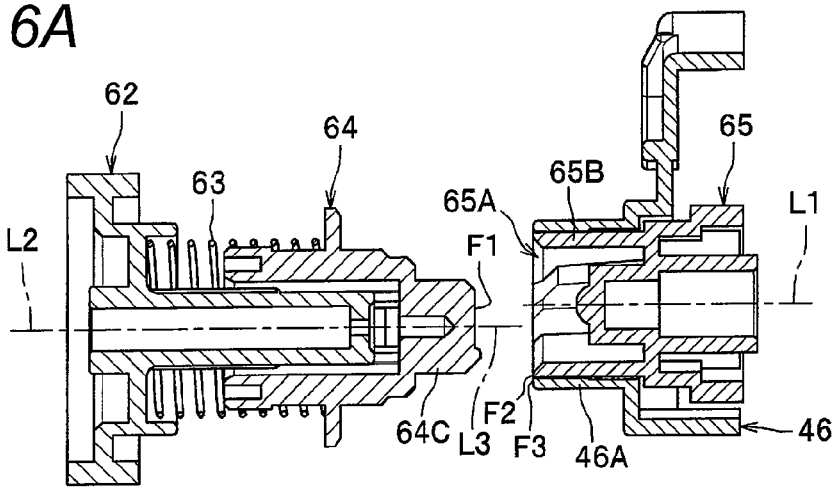
FIG. 6A, FIG. 6B and FIG. 6C are cross-sectional views of operations in case the driving force transmission member swings when moving forward and rotation axis lines of a rotation driving axis and an input member are deviated from each other.
Figure 6B:
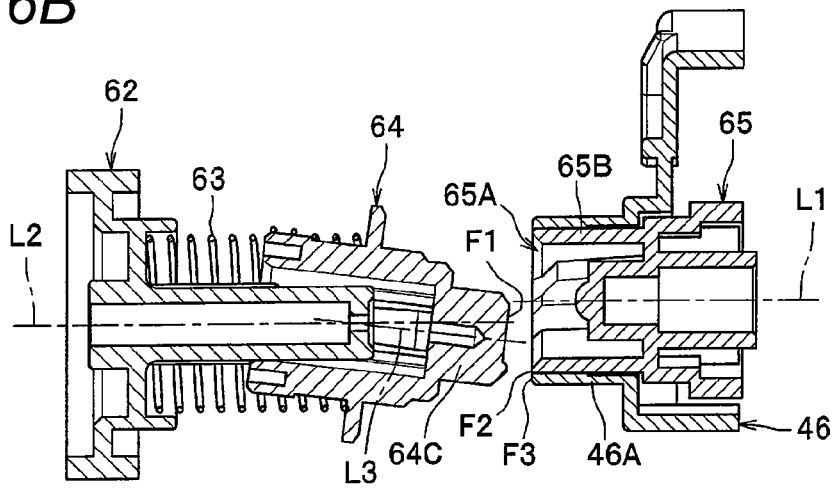
Figure 6C:
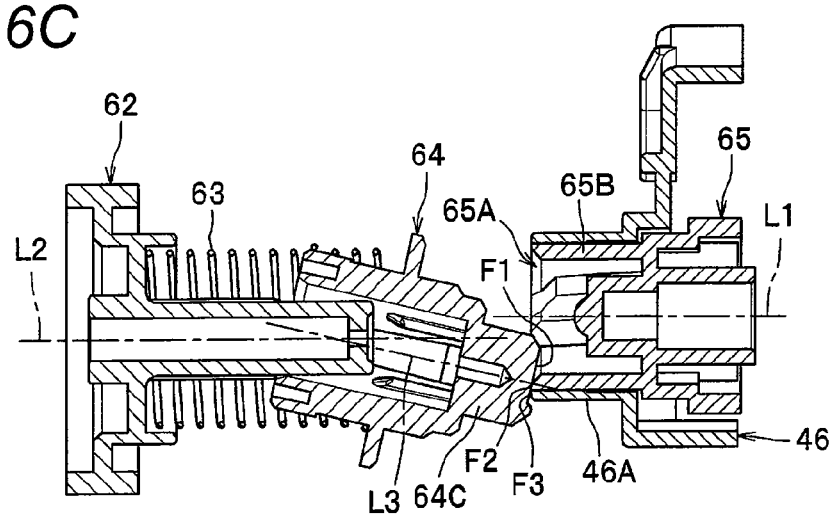

Operations of the driving force transmission mechanism 60 will be described with reference to FIG. 6 and FIG. 8. As shown in FIG. 6, for example, the rotation axis line L2 of the rotation driving shaft 62B and the rotation axis line L1 of the input member 65 may be deviated from each other due to the manufacturing errors. In this case, when the driving force transmission member 64 moves forward, following the closing of the front cover 21, toward the input member 65, a center region (the rotation axis line L3) of the tip end face F1 may be in a contact with the edge of the concave shape portion 65A as shown in FIG. 6B and FIG. 6C when the driving force transmission member 64 may swing.

Where the center region (the rotation axis line L3) of the tip end face F1 may, in such a way, be in a contact with the edge of the concave shape portion 65A, the rotation driving member 62 may rotate with the driving force from the driving source 61 of the main body 2 so as to transmit the driving force to the driving force transmission member 64. In this time, if the protrusion 64G is not formed on the tip end face F1 of the driving force transmission member 64, the tip end 64C of the driving force transmission member 64 is never engaged with any portions of the input member 65. Accordingly, there occurs the problem that the driving force transmission member 64 may rotate in vain around the rotation axis line L3, that is to say, the rotation of the driving force transmission member 64 is not transmitted to the input member.

Figure 7A:
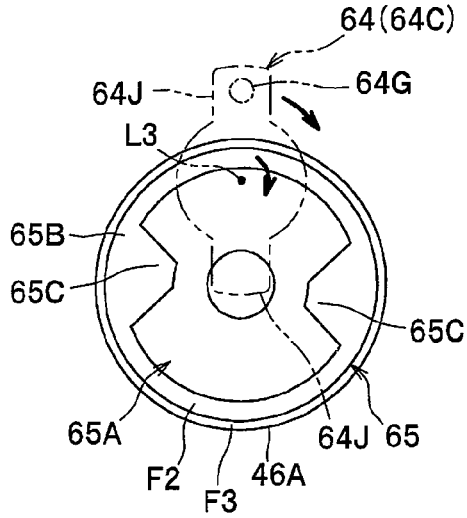
FIG. 7A and FIG. 7B illustrate operations of the driving force transmission member until the protrusion enters into the concave shape portion from a position out of the concave shape portion.
Figure 7B:
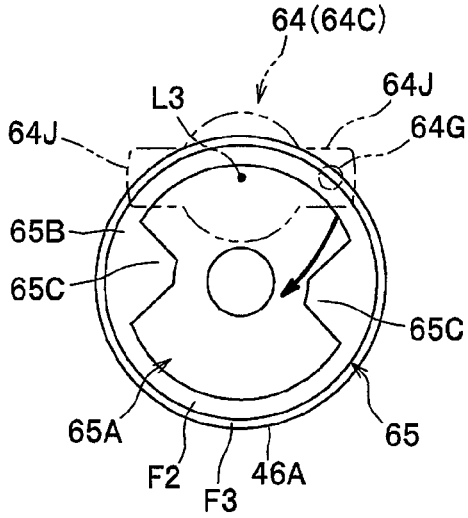

To the contrary, in this embodiment, the protrusion 64G is formed on the tip end face F1 of the driving force transmission member 64. Meanwhile, as shown in FIG. 6, the rotation axis line L2 of the rotation driving shaft 62B and the rotation axis line L1 of the input member 65 may be deviated from each other due to the manufacturing errors. Therefore, as mentioned above, the center region (the rotation axis line L3) of the tip end face F1 may be in a contact with the edge of the concave shape portion 65A as shown in FIG. 6. In this state, when the driving force transmission member 64 may swing, the portions of the driving force transmission member 64 (to be strict, the tip end 64C) are tilted so as to enter into the concave shape portion 65A. As shown in FIG. 7A and FIG. 7B, for example, if the protrusion 64G is positioned out of the concave shape portion 65A when the driving force transmission member 64 and the input member 65 are in a contact with each other, the driving force transmission member 64 is tilted so that one of the transmission side engagement portions 64J on which the protrusion 64G is not formed enters into the concave shape portion 65A. In this state, the driving force transmission member 64 rotates around the rotation axis line L3 in an arrow direction of FIG. 7, and, thus, the protrusion 64G moves in a circular way relative to the end face F2 of the input member 65 and the end face F3 (refer to FIG. 6C) of a cylindrical portion 46A surrounding the input member 65. As a result, the protrusion 64G becomes adjacent to the end faces F2, F3 from the outer side. Herein, the cylindrical portion 46A is integral to the process cartridge 46 and the end face F3 thereof is substantially flush with the end face F2 of the input member 45. When the protrusion 64G is about to be in a contact with the end faces F2, F3, the driving force transmission member 64 rotates so that one of the transmission side engagement portions 64J on which the protrusion 64G is not formed becomes adjacent to the end faces F2, F3 from the inner side. Then, the protrusion 64G is in a contact with the end faces F2, F3 from the outer side and thus slides on the end faces F2, F3 to enter into the concave shape portion 65A.

Meanwhile, at this time, in case the protrusion 64G is in a contact with and is engaged with an outer peripheral face (an outer peripheral side of the outer wall portion 65B) of the cylindrical portion 46A, the portion of the driving force transmission member 64, when being in a contact with the input member 65, is tilted so as to enter into the concave shape portion 65A. Accordingly, only the tip end of the protrusion 64G is in a contact with the outer peripheral face of the cylindrical portion 46A, and, therefore, the protrusion 64G may easily slide beyond the outer peripheral face (corner portion) of the cylindrical portion 46A with the swing of the driving force transmission member 64. To be more specific, because the driving force transmission member 64 is tilted so that one of the transmission side engagement portions 64J on which the protrusion 64G is not formed enters into the concave shape portion 65A, the tip end of the protrusion 64G positioned out of the cylindrical portion 46A is placed at the position more distant in the axis direction than the end faces F2, F3 or at substantially the same position as the end faces, so that the range in which the protrusion 64G is engaged with the outer peripheral face of the cylindrical portion 46A becomes very small. In this way, when the protrusion 64G positioned out of the cylindrical portion 46A becomes in a contact with the outer peripheral face of the cylindrical portion 46A, the protrusion 64G may easily slide beyond the cylindrical portion 46A and the outer wall portion 65B with the swing of the driving force transmission member 64 so as to enter into the concave shape portion 65A.

When the driving force transmission member 64 further rotates from the state as shown in FIG. 7B, the protrusion 64G of the tip end 64C moves so as to be adjacent to the bottom of the concave shape portion 65A and at the same time one of the transmission side engagement portions 64J on which the protrusion 64G is not formed moves so as to be far away from the end faces F2, F3 in the axis direction since the driving force transmission member 64 is tilted relative to the end faces F2, F3.

Figure 8A:
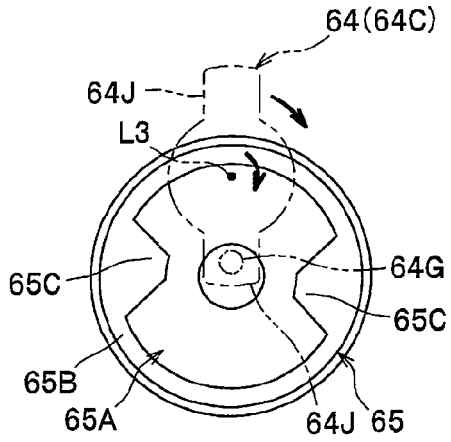
FIG. 8A, FIG. 8B, FIG. 8C and FIG. 8D illustrate operations of the driving force transmission member after the protrusion enters into the concave shape portion.

As shown in FIG. 8A, when the protrusion 64G has entered into the concave shape portion, the driving force transmission member 64 swings so that the protrusion 64G is pressed into the concave shape portion 65A with the pressing force of the coil spring 63. Then, as shown in FIG. 8B, the protrusion 64G is engaged, from the inner side, with the edge (the outer wall portion 65B) of the concave shape portion 65A of the input member 65.

Figure 8C:
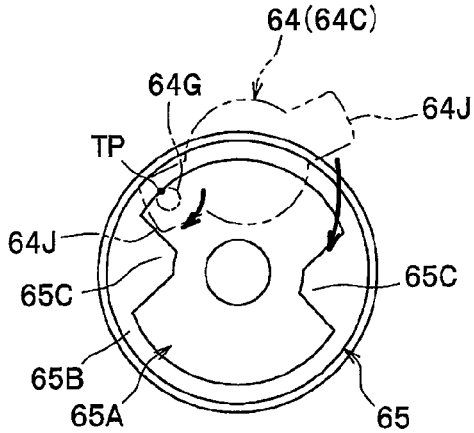
Figure 8B:
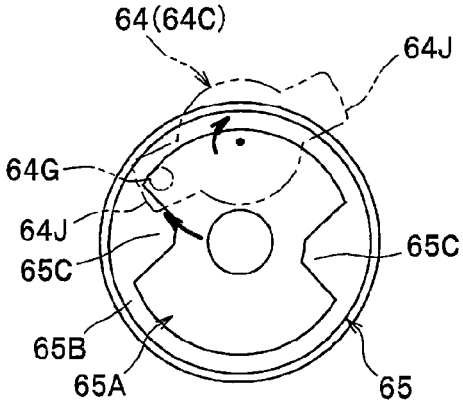
Figure 8D:
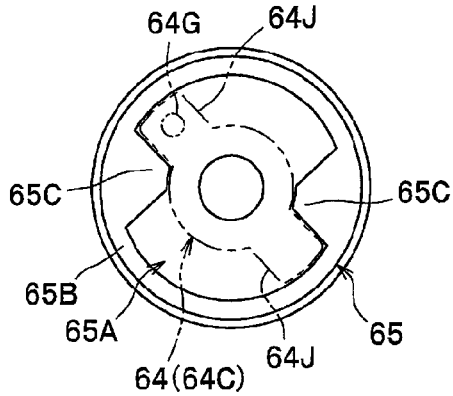

After the protrusion 64G is engaged, from the inner side, with the edge (the outer wall portion 65B) of the concave shape portion 65A of the input member 65, the driving force transmission member 64 rotates around the engagement point TP between the protrusion 64G and the outer wall portion 65B as shown in FIG. 8C. In this way, the portion of the tip end 64C protruding toward the outside of the concave shape portion 65A (one of the transmission side engagement portions 64J on which the protrusion 64G is not formed) rotates toward the inner side of the concave shape portion 65A. As a result, as shown in FIG. 8D, the tip end 64C of the driving force transmission member 64 enters rapidly into the concave shape portion 65A.

Here, in order that the protrusion 64G operates in such a manner, the rotation axis line L3 when the driving force transmission member 64 swings to the maximum degree needs to be placed at a more inner position than the outer circumference of the input member 65 (to be strict, the cylindrical portion 46A). That is, when the driving force transmission member 64 swings to the maximum degree, it is necessary that it is possible for the portion of the driving force transmission member 64 to enter into the concave shape portion 65A. Under this condition, the tolerance of the deviation between the rotation axis lines L1, L2 is set.

It is preferable that an angle formed between the tip end face F1 and the end faces F2, F3 is smaller than an angle formed between the tip end face F1 and the inner peripheral face of the concave shape portion 65A. That is, as the angle formed between the tip end face F1 and the inner peripheral face of the concave shape portion 65A gets larger (gets near a right angle), the protrusion 64G tends to be easily engaged with the inner peripheral face (edge) of the concave shape portion 65A. As the angle formed between the tip end face F1 and the end faces F2, F3 gets smaller, the protrusion 64G may easily slide onto the end faces F2, F3. In that way, such an operation may be reliably realized.

In accordance with this embodiment, following effects are exhibited.

In case the tip end face F1 of the driving force transmission member 64 gets in a contact with the edge of the concave shape portion 65A of the input member 65, the protrusion 64G on the tip end face F1 comes into being engaged from the inner side with the edge of the concave shape portion 65A, so that the engagement point TP becomes a new rotational center point. In this way, the tip end 64C of the driving force transmission member 64 securely enters into the concave shape portion 65A of the input member 65. Accordingly, this can broaden the deviation tolerance between the central axis L1 of the rotation driving axis and the central axis L2 of the input member. That is, when the deviation between the central axis L1 of the rotation driving axis and the central axis L2 of the input member is lager than that in the conventional approach, the driving force transmission member 64 and the input member 65 are able to be engaged with each other.

When the tip end face F1 entering into the concave shape portion swings to a maximum degree with a fixed point being a contact point between the tip end face F1 and the convex portion 65E, the protrusion 64G is formed with a height in such a way not to interfere with the convex portion 65E and the bottom 65D. Accordingly, the protrusion 64G is prevented from interfering with the rotation of the driving force transmission member 64.

Meanwhile, the invention is not limited to such an embodiment, but the invention includes various embodiments as illustrated by way of examples below.

Figure 9:
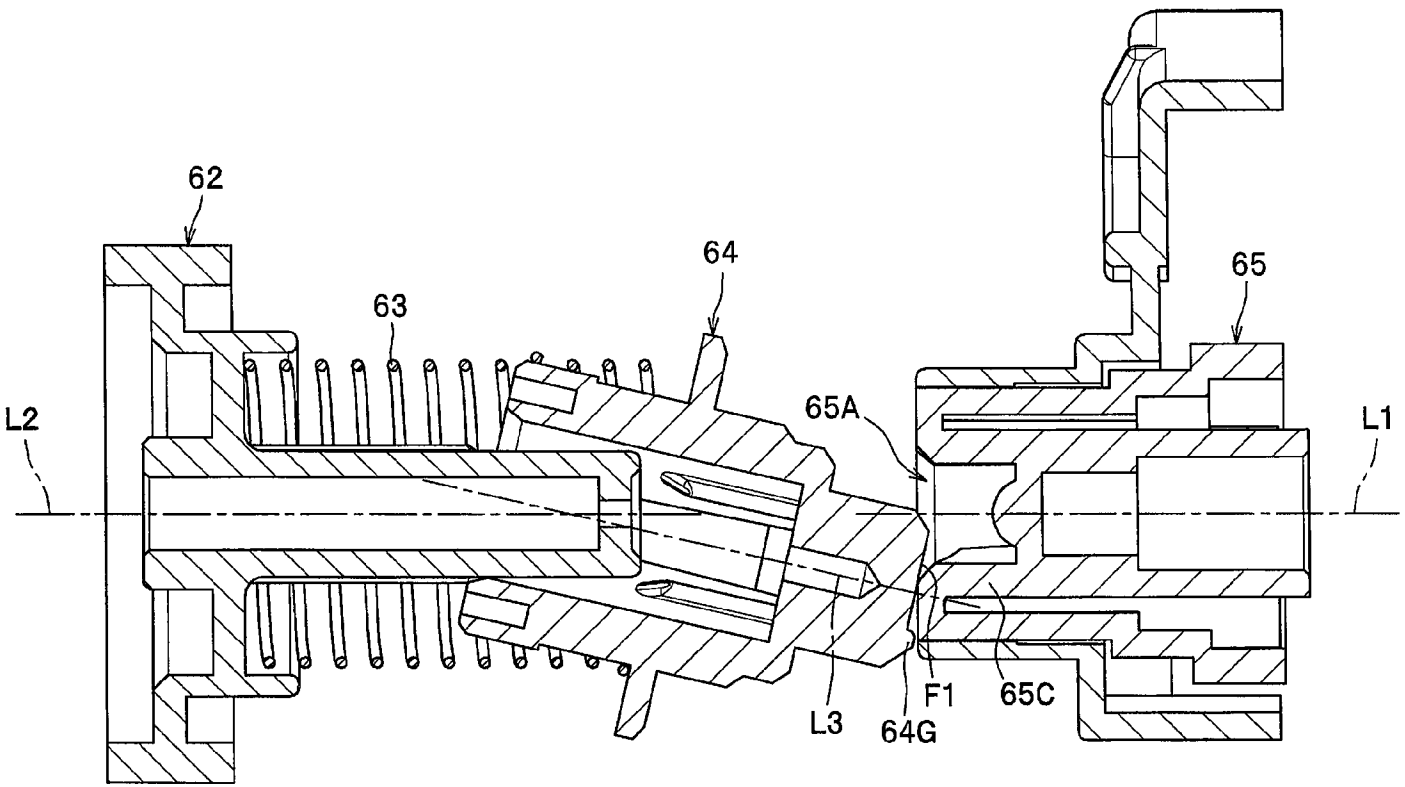
FIG. 9 shows a state in which a tip end face of the driving force transmission member is in a contact with an input side engagement portion so that the driving force transmission member is oblique, in case the rotation axis lines of the rotation driving axis and the input member match with each other.
Figure 10:
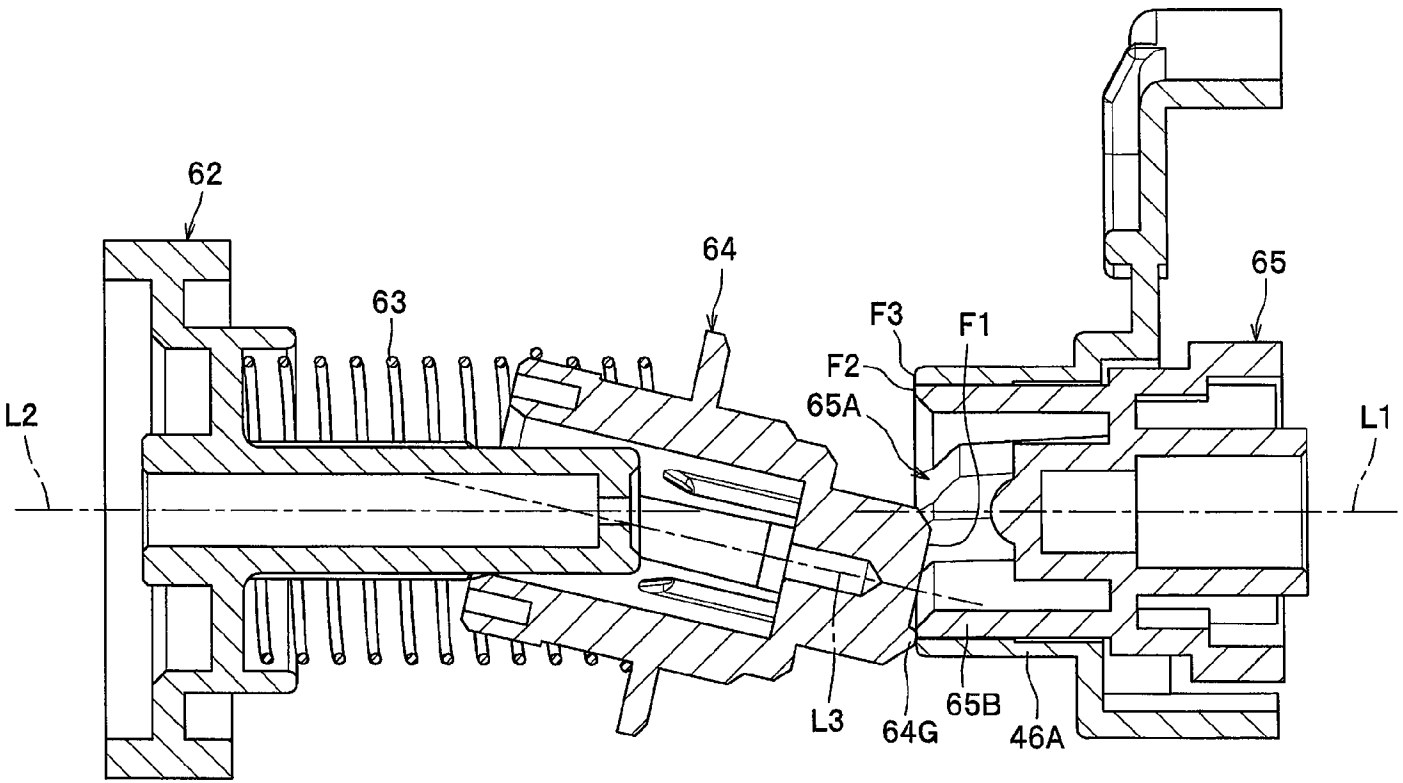
FIG. 10 shows a state in which the protrusion of the driving force transmission member is in a contact with an outer wall portion so that the driving force transmission member is oblique, in case the rotation axis lines of the rotation driving axis and the input member match with each other.

Although in the illustrative embodiment, the situation in which rotation axis lines L1, L2 of the rotation driving axis 62 and the input member 65 are deviated from each other is exemplified, the invention is not limited thereto. That is, as shown in FIG. 9 and FIG. 10, in the situation in which the rotation axis lines L1, L2 of the rotation driving axis and the input member match with each other, the same effects are exhibited. To be specific, in case as shown in FIG. 9, the central region of the tip end face F1 is in a contact with an inner edge of the input side engagement portion 65C due to the swing of the driving force transmission member 64, the protrusion 64G enters into the portion 65A and then is engaged from the inner side with the edge of the concave shape portion 65A as in the illustrative embodiment. Moreover, in case as shown in FIG. 10, the protrusion 64G is in a direct contact with the end face F2 of the input member 65 and the end face F3 of the cylindrical portion 46A, the protrusion 64G slides on the end faces F2, F3 and then enters into the portion 65A and is engaged from the inner side with the edge of the concave shape portion 65A as in the illustrative embodiment. In that way, the driving force transmission member 64 is securely guided into the concave shape portion 65A.

Figure 11A:
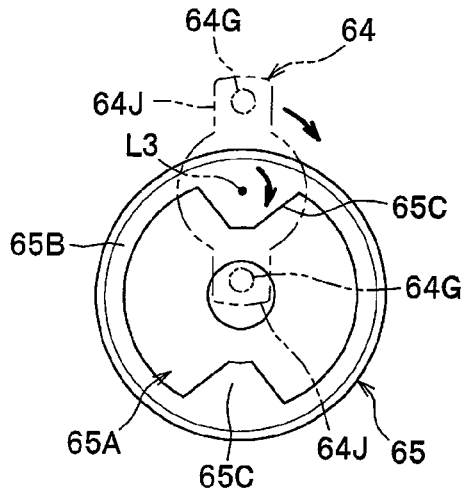
FIG. 11A and FIG. 11B illustrate forms in which two protrusions are formed on the tip end.
Figure 11B:
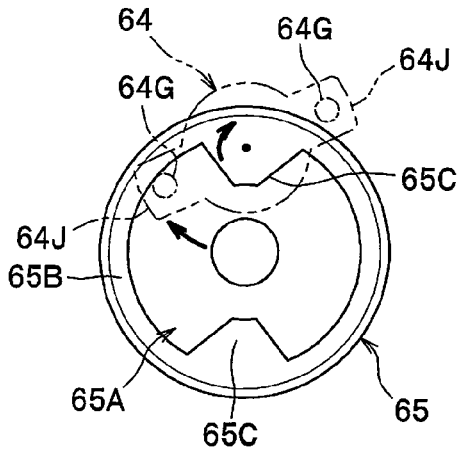

Although in the illustrative embodiment, the protrusion 64G is formed only on one of the pair of the transmission side engagement portions 64J, the invention is not limited thereto. That is, as shown in FIG. 11, the protrusions 64G are formed on both of the pair of the transmission side engagement portions 64J. In this way, as shown in FIG. 11A and FIG. 11B, after the driving force transmission member 64 is in a contact with the edge of the concave shape portion 65A, one of the protrusions 64G is engaged from the inner side with the edge of the concave shape portion 65A before the driving force transmission member 64 rotates by 180° around the rotation axis line L3. Accordingly, the tip end 64C of the driving force transmission member 64 enters more rapidly into the concave shape portion 65A.

Although in the illustrative embodiment, the invention is applied to the color laser printer 1, the invention is not limited thereto. For example, the invention may be applied to other image forming apparatus such as a copying machine or a multi-function machine. Otherwise, the invention may be applied to other driving force transmission mechanisms. For example, the invention may be applied to a driving force transmission mechanism connecting a cutter in a bottle to a motor in a food mixer in which the bottle is attachable or detachable to or from a main body incorporating the motor.

Although in the illustrative embodiment, the coil spring 63 is used as spring means, the invention is not limited thereto. For example, the spring means employs a linear spring or disk spring.

Although in the illustrative embodiment, the cylindrical portion 64A of the driving force transmission member 64 is fitted with the rotation driving shaft 62B, the invention is not limited thereto. That is, the fitting structure between the cylindrical portion and the rotation driving axis is configured vice versa.

What is claimed is:

1. A driving force transmission mechanism that is provided between a driving force supplying member having a driving source and a driving force receiving member configured to be detachably provided in the driving force supplying member, the driving force transmission mechanism configured to transmit driving force from the driving force supplying member to the driving force receiving member, the driving force transmission mechanism comprising:

an input member that is rotatably provided in the driving force receiving member, the input member including a concave shape portion that receives the driving force from the driving force supplying member;

a rotation driving shaft that is rotatably provided in the driving force supplying member; and a driving force transmission member that is configured to rotate in a rotation direction of the rotation driving shaft together with the rotation driving shaft, the driving force transmission member configured to be movable forward and backward relative to the driving force receiving member in a parallel direction with a rotation axis line of the rotation driving shaft, the driving force transmission member being supported by the rotation driving shaft so that a tip end portion of the driving force transmission member, which is close to the driving force receiving member, swings in a direction perpendicular to the rotation axis line of the rotation driving shaft, the driving force transmission member configured to rotate together with the input member when the tip end portion enters into and is engaged with the concave shape portion, wherein, when the driving force receiving member is mounted in the driving force supplying member, the input member has a substantially parallel rotation axis line with the rotation axis line of the rotation driving shaft;

wherein, when the tip end portion does not enter into the concave shape portion, the concave shape portion has at least a portion that is overlapped with the tip end portion when viewed in the direction of the rotation axis line of the driving shaft; and wherein a protrusion is formed on a portion of a surface of the tip end portion, the surface being opposed to the concave shape portion, the protrusion is configured to be engaged, from an inner side, with an edge of the concave shape portion when the tip end portion is in contact with the edge of the concave shape portion and is tilted, the protrusion is formed on the portion that is deviated from the rotation axis line of the rotation driving shaft in a diameter direction with the rotation axis line of the input member.

2. The driving force transmission mechanism according to claim 1, wherein a gap exists in a diameter direction between the driving force transmission member and an outer periphery of the rotation driving shaft; and wherein the driving force transmission member slides in a direction parallel with the rotation axis line of the rotation driving shaft and is supported so as to swing in a direction perpendicular to the rotation axis line of the rotation driving shaft.

3. The driving force transmission mechanism according to claim 1, wherein the driving force transmission member is pressed toward the input member with a spring member.

4. The driving force transmission mechanism according to claim 1, wherein the concave shape portion comprises:

a cylindrical outer wall portion; and an input side engagement portion that protrudes from the outer wall portion toward an inner side, the input side engagement portion configured to be engaged in the rotation direction with the tip end portion of the driving force transmission member;

wherein, in case the protrusion is positioned out of the outer wall portion when the surface of the tip end portion is in contact with a surface of the outer wall portion close to the driving force transmission member, the protrusion is in contact with an outer peripheral portion or the surface of the outer wall portion by the rotation of the driving force transmission member; and wherein the driving force transmission member is configured to swing relative to the rotation driving shaft based on the contact between the protrusion and the outer peripheral portion or the surface of the outer wall portion.

5. The driving force transmission mechanism according to claim 4, wherein the tip end portion of the driving force transmission member includes a pair of transmission side engagement portions which is formed so as to sandwich the rotation axis line of the rotation driving shaft therebetween, the pair of transmission side engagement portions extending in an outer side direction of a diameter of the cylindrical outer wall portion and in an opposite direction from each other and which are engaged in the rotation direction with the input side engagement portion; and wherein the protrusion is formed on at least one of the pair of transmission side engagement portions.

6. The driving force transmission mechanism according to claim 5, wherein the protrusions are formed respectively on the pair of transmission side engagement portions.

7. The driving force transmission mechanism according to claim 1, wherein, in a rotational center of a bottom of the concave shape portion, a semi-spherical convex portion is formed to be in a contact with the surface of the tip end portion of the driving force transmission member; and wherein, when the surface of the tip end portion, configured to enter into the concave shape portion, swings to a maximum degree with respect to a contact point between the surface of the tip end portion and the convex portion, the protrusion is formed with a height so as not to interfere with the convex portion and the bottom.

8. An image forming apparatus, comprising:

the driving force transmission mechanism according to claim 1, wherein the driving force supplying member is an apparatus main body, and the driving force receiving member is a cartridge configured to be detachably provided in the apparatus main body.

* * * * *